US012590728B2

(12) United States Patent
Archuleta et al.

(10) Patent No.: US 12,590,728 B2
(45) Date of Patent: Mar. 31, 2026

(54) MODULAR FLOOR CASSETTE

(71) Applicant: United States of America as Represented by the Secretary of Agriculture, Washington, DC (US)

(72) Inventors: James Geronimo Archuleta, Pilot Rock, OR (US); Benjamin Kaiser, Portland, OR (US); Emily Dawson, Portland, OR (US)

( * ) Notice: Subject to any disclaimer, the term of this patent is extended or adjusted under 35 U.S.C. 154(b) by 259 days.

(21) Appl. No.: 18/109,368

(22) Filed: Feb. 14, 2023

(65) Prior Publication Data

US 2023/0296287 A1 Sep. 21, 2023

Related U.S. Application Data

(60) Provisional application No. 63/321,832, filed on Mar. 21, 2022.

(51) Int. Cl.
*F24F 13/22* (2006.01)

(52) U.S. Cl.
CPC ..... *F24F 13/222* (2013.01)

(58) Field of Classification Search
CPC ..... F24F 13/222; F24F 7/10
See application file for complete search history.

(56) References Cited

U.S. PATENT DOCUMENTS

| | | | | |
|---|---|---|---|---|
| 4,077,158 | A * | 3/1978 | England | A01G 31/02 47/17 |
| 4,365,619 | A * | 12/1982 | Holbrook | F24F 5/0046 261/151 |
| 4,513,545 | A | 4/1985 | Hopkins, Jr. | |
| 10,704,251 | B1 | 7/2020 | Rubler | |
| 10,947,720 | B2 | 3/2021 | Miller | |
| 2021/0376787 | A1* | 12/2021 | Ryan | H02S 30/20 |

* cited by examiner

*Primary Examiner* — David R Dunn

(57) ABSTRACT

A floor cassette for a housing module includes a base that is sized to fit under a floor of the modular housing unit. The floor cassette also includes a perimeter drain incorporated into a perimeter of the base, where the perimeter drain comprises a cavity designed to collect liquid from the floor of the modular housing unit. The cavity of the perimeter drain also comprises an air duct that delivers heated or cooled air to the modular housing unit.

18 Claims, 10 Drawing Sheets

MODULAR FLOOR CASSETTE

CROSS-REFERENCE TO RELATED APPLICATION

The present application claims the priority benefit of U.S. Provisional Patent App. No. 63/321,832 filed on Mar. 21, 2022, the entire disclosure of which is incorporated by reference herein.

BACKGROUND

A modular home generally refers to a housing unit that is primarily built offsite (e.g., in a factory) and then transported to a job site destination for permanent placement. A traditional modular home is generally constructed and shipped in multiple subunits that are then assembled at the job site to complete the housing unit. Unlike a manufactured (i.e., mobile) home, a modular home is generally a stick-built structure that is required to comply with local building codes and regulations. Modular homes are often thought to be more energy efficient and more sturdily constructed than traditional stick-built homes due in part to the fact that they are built indoors and need to have a robust structure that can undergo the stresses involved with lifting, transportation, and assembly of the modular unit.

SUMMARY

An illustrative floor cassette for a housing module includes a base that is sized to fit under an accessible floor of the modular housing unit. The floor cassette also includes a perimeter drain incorporated into a perimeter of the base, where the perimeter drain comprises a cavity designed to collect liquid from the floor of the modular housing unit. The cavity of the perimeter drain also comprises an air duct that delivers heated or cooled air to the modular housing unit as well as a majority of the electrical distribution for the housing unit.

In one embodiment, the floor cassette also includes an area drain spaced away from the perimeter of the base, where the area drain directs collected liquid from the floor to the cavity of the perimeter drain. In an illustrative embodiment, the base comprises thermoformed plastic. The cassette can also include a plurality of grates that cover the cavity of the perimeter drain, where at least a portion of the plurality of grates are interchangeable grates that can swap positions with one another. Another embodiment, includes an electrical outlet mounted in an interchangeable grate of the plurality of grates such that the electrical outlet can be moved from a first location along the perimeter drain to a second position along the perimeter drain. In another embodiment, the cavity of the perimeter drain acts as a raceway for an electrical line that supplies power to the electrical outlet. In another embodiment, the cavity of the perimeter drain acts as a raceway for an information technology line that supplies network access to the housing module.

The cassette can also include a one-piece water supply line incorporated into the base, and a one point water line connection that is mounted to the one-piece water supply line and that extends through an external wall of the base. To accommodate the occasional stacking of the modules, the one piece water line may extend vertically to allow for a connection to the module above. The cassette can further include a one-piece plumbing drain line incorporated into the base, where at least a portion of the one-piece plumbing drain line extends vertically within the cavity of the perimeter drain to accommodate stacking of housing modules. The cassette can also include a wiring harness mounted in a raceway formed in the base, where the wiring harness connects to an electrical supply line and to an information technology supply line. The cassette can also include one or more batteries mounted in a housing formed in the base, where the one or more batteries are connected to the wiring harness to provide back-up power to the housing module.

An illustrative method of forming a floor cassette includes forming a base of the floor cassette that is sized to fit under a floor of the modular housing unit. The method also includes forming a perimeter drain in the base wherein forming the perimeter drain comprises forming a cavity designed to collect liquid from the floor of the modular housing unit. The cavity of the perimeter drain is formed such that the cavity also comprises an air duct that delivers heated or cooled air to the modular housing unit.

The method can also include forming an area drain in the base that is spaced away from the perimeter of the base such that the area drain directs collected liquid from the floor to the cavity of the perimeter drain. The method can further include mounting a plurality of grates to cover the cavity of the perimeter drain, where at least a portion of the plurality of grates are interchangeable grates that can swap positions with one another. The method can also include mounting an electrical outlet to at least one interchangeable grate such that the electrical outlet is movable from a first location to a second location along the perimeter of the housing module. The method can also include mounting an electrical line and an information technology line in a raceway that is formed in the cavity of the perimeter drain. The method can also include mounting a one-piece water supply line and a one-piece plumbing drain line into the base. The method can further include forming a housing in the base and mounting one or more batteries in the housing, where the one or more batteries are connected to a wiring harness to provide back-up power to the housing module.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Operational features of modular and non-modular homes are typically distributed throughout a volumetric block, consolidated within walls, or situated in the cavities created by constructing the home or module itself. The integrated construction of such operational features within a housing module prevents their construction independent of the module itself. This results in the need for numerous skilled tradesmen at the jobsite, including electricians, heating, ventilation, and air conditioning (HVAC) specialists, plumbers, information technology (IT) specialists, etc. However, by aggregating operational features in the floor of a housing module and by utilizing a design for manufacturing and assembly process (DfMA), several efficiency and cost-saving benefits follow. As discussed in more detail below, the efficiency and cost-savings benefits can include unit-wide water drainage, integrated and preformed ducting, movable floor electrical outlets, vertical sound dampening, independent and pre-wired internet capabilities, and pre-formed water supply and waste lines. The prefabrication and integration of the majority of the operational features into a floor cassette circumvents the need for additional wiring, plumbing, and other installations throughout the balance of the unit configuration, thereby eliminating the need for numerous onsite tradesmen.

More specifically, described herein is a prefabricated utility cassette that is sized to be placed within the floor of a mass housing module. In an illustrative embodiment, the cassette is produced using thermoformed plastic (or a similar material) that is constructed to provide predefined spaces to house the aforementioned operational systems. The cassette integrates all operational features of the housing module, and includes an HVAC system, an integrated water distribution and waste line system, an electrical distribution system, a data and technology distribution system, and a comprehensive drainage system. Cassette systems can be remotely monitored via an internet connection, enabling the operating systems to be remotely managed for necessary maintenance, problem mitigation, efficiency monitoring, etc.

Figure 1:
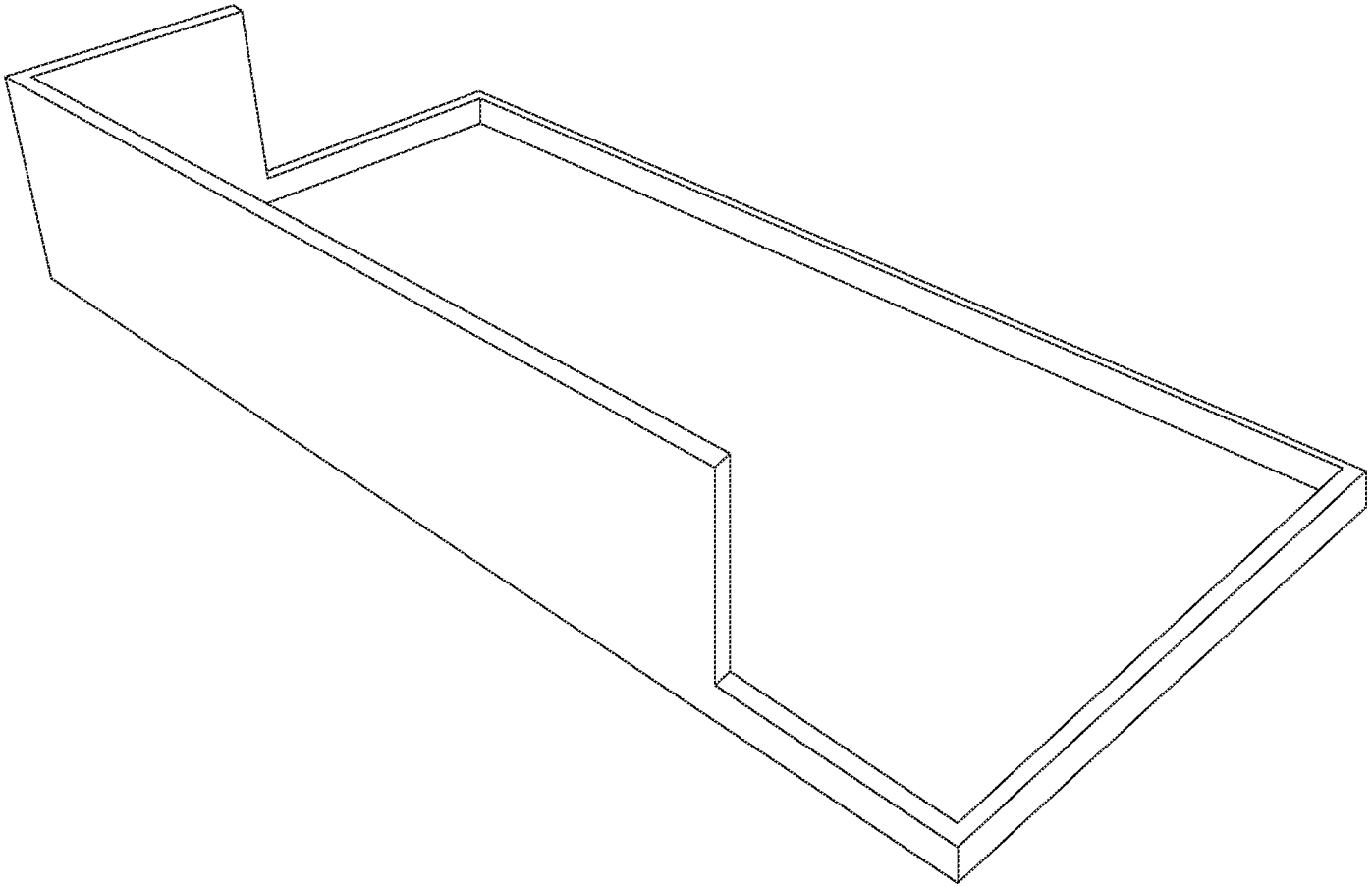
FIG. 1 depicts a partial view of a wooden housing module designed to receive a floor cassette in accordance with an illustrative embodiment.

In an illustrative embodiment, the proposed floor cassette is sized to fit within a housing module, which can be made from mass timber or another material. FIG. 1 depicts a partial view of a wooden housing module designed to receive a floor cassette in accordance with an illustrative embodiment. In the embodiment shown, the housing module has dimensions of 26 feet long by 12 feet wide by 10 feet 3 inches high. In alternative embodiments, the housing module and corresponding floor cassette can be connected to other modules with similar corresponding floor cassette layouts, depending on the desired home design. As shown in FIG. 1, the housing module includes a tray that is formed by a base of the housing module and its side walls and end walls, and the tray is sized to receive the floor cassette. The base, side walls, and/or end walls can be constructed using mass plywood panels, cross-laminated panels, or other prefabricated materials.

The housing module depicted in FIG. 1 can be combined with one or more additional housing modules such that different sizes and styles of homes can be constructed. For example, a single housing module may be used for a studio apartment, and multiple housing modules may be used to form 1 bedroom, 2 bedroom, 3 bedroom, etc. homes. The housing modules can also be stacked, vertically, to allow for multi-family construction. Due to the floor cassette design, the housing modules can be constructed in a very high volume factory utilizing mass timber products and other products along the housing supply chain.

Figure 2:
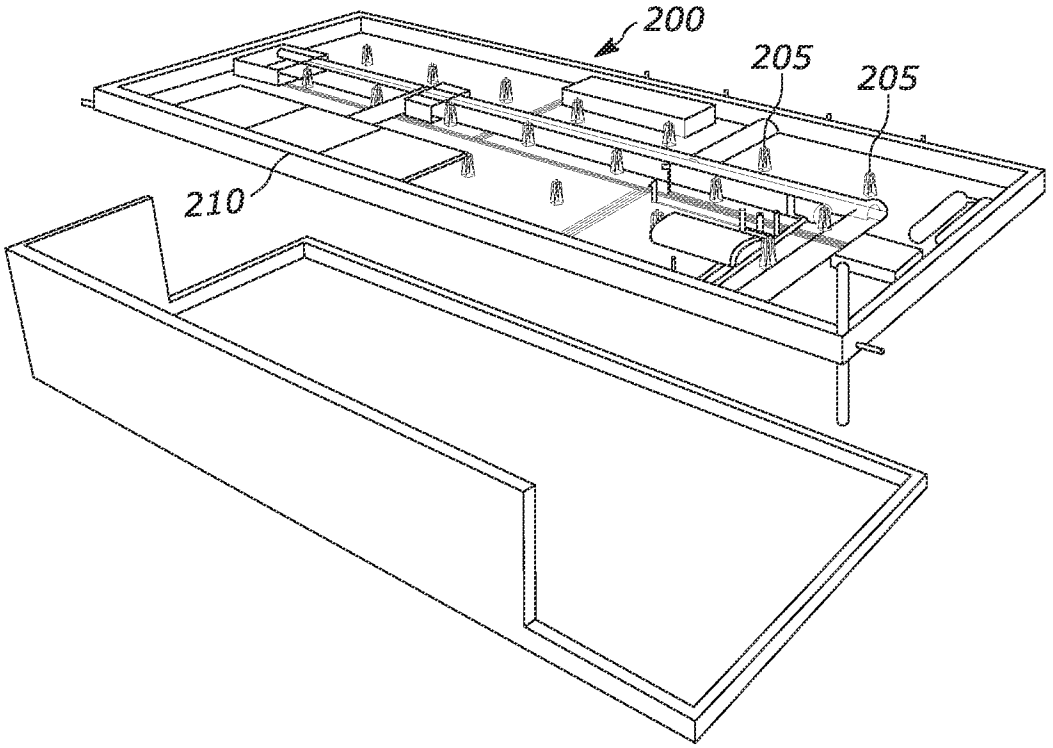
FIG. 2 depicts a floor cassette in accordance with an illustrative embodiment.

FIG. 2 depicts a floor cassette 200 in accordance with an illustrative embodiment. In an illustrative embodiment, the floor cassette 200 is sized to fit within the tray formed in the housing module shown in FIG. 1. In one embodiment, a waterproof vacuum formed liner (e.g., ethylene propylene diene monomer (EPDM) rubber, silicon, etc.) is mounted between the wood of the housing module and the floor cassette 200. The floor cassette 200 includes all of the operational features of the housing module, including an HVAC system, a plumbing system, a water supply system, an electrical distribution system, a data and technology distribution system, and a comprehensive drainage system. In one embodiment, dimensions of the floor cassette can be approximately 11 feet 2 inches wide, by approximately 25 feet 6 inches long, by 10 inches deep.

In another illustrative embodiment, the systems included in the floor cassette incorporate sensors such that remote monitoring of each system can be performed using the data and technology distribution system. This will allow the operating systems in each housing module to be managed for necessary maintenance (filter replacements, belts replacements, etc.), problem mitigation (leaks, breakdowns, etc.), and cost management of the operational costs for the module. The monitoring can be performed by the tenant (or individual owner) of the housing module and/or by an owner of a complex of housing modules.

Figure 3:
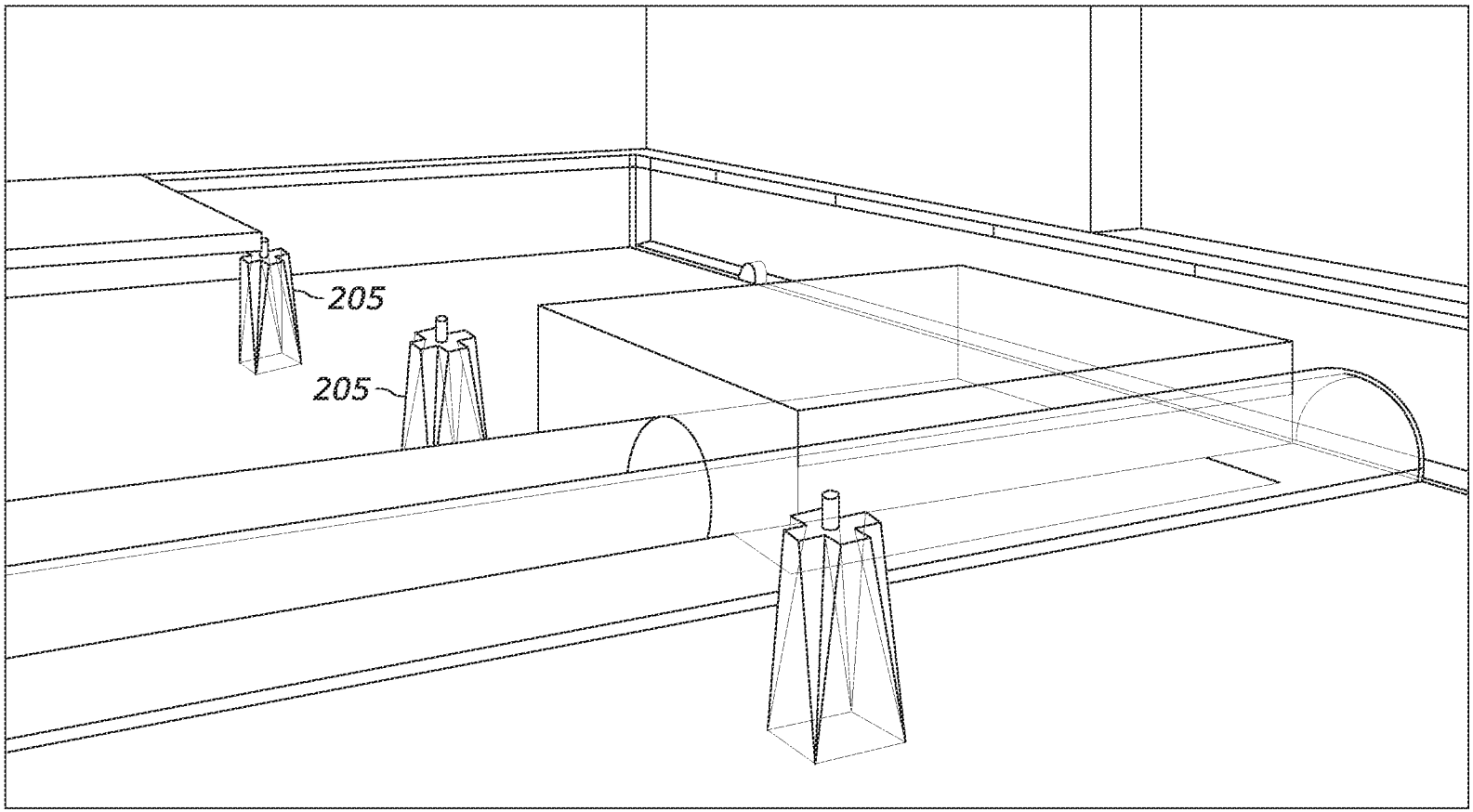
FIG. 3 is a close-up view of a portion of the floor cassette that includes the integrated pedestals in accordance with an illustrative embodiment.

In an illustrative embodiment, the floor cassette 200 is produced using thermoformed plastic or a similar material, such as rubber, silicon, metal, etc. The floor cassette 200 is formed to have precisely dimensioned, predefined spaces to house each of the operational systems for the housing module. As shown, the foundation cassette 200 also includes several rows of integrated pedestals 205 which are designed to support a raised floor system for the housing module. FIG. 3 is a close-up view of a portion of the floor cassette 200 that includes the integrated pedestals 205 in accordance with an illustrative embodiment. The raised floor system can be finished using standard flooring options such as laminate, wood, vinyl, carpet, etc. In an illustrative embodiment, at least a portion of the raised floor system can be implemented as removable panels (e.g., 2 feet×3 feet) that provide access to the cassette. As discussed in more detail below, the floor cassette also includes integrated and molded ductwork for the supply and return air systems, cohesive and unperforated drainage protection, and insulation for both sound and thermal protection.

The floor cassette 200 is designed to have dual drainage systems to prevent water damage due to overflowing dishwashers, washing machines, showers, sinks, and other non-plumbing related water issues. The dual drainage system includes standard plumbing drains, along with a secondary drainage system in the form of a perimeter drain 210 and an area drain that collects water and drains it to the outside of the floor cassette and the housing module. Additionally, the secondary perimeter drain 210 is designed to be multifunctional such that it provides a channel or raceway for the distribution of electrical/data lines throughout the housing module, a channel that accepts floor outlets in a variety of positions such that the outlets can be moved by the occupant, and a channel for air supply distribution throughout the housing module.

The floor cassette 200 also includes a single piece water supply system and a single piece waste line system that precludes pipe joints and their associated failures. The single piece water supply and waste line systems can be custom formed to fit within the cavities of the foundation cassette 200, thereby eliminating the need for an onsite plumber to put in the systems during erection of the housing module. In an illustrative embodiment, the water supply system and the waste line system are stackable such that housing modules can be interconnected vertically (i.e., stacked). The floor cassette 200 also includes a wiring harness, with (or without) battery backup, to supply electrical power to the module. An Internet connection is also provided such that the tenant has network access, and also such that the various systems can be monitored and/or controlled remotely.

Figure 4:
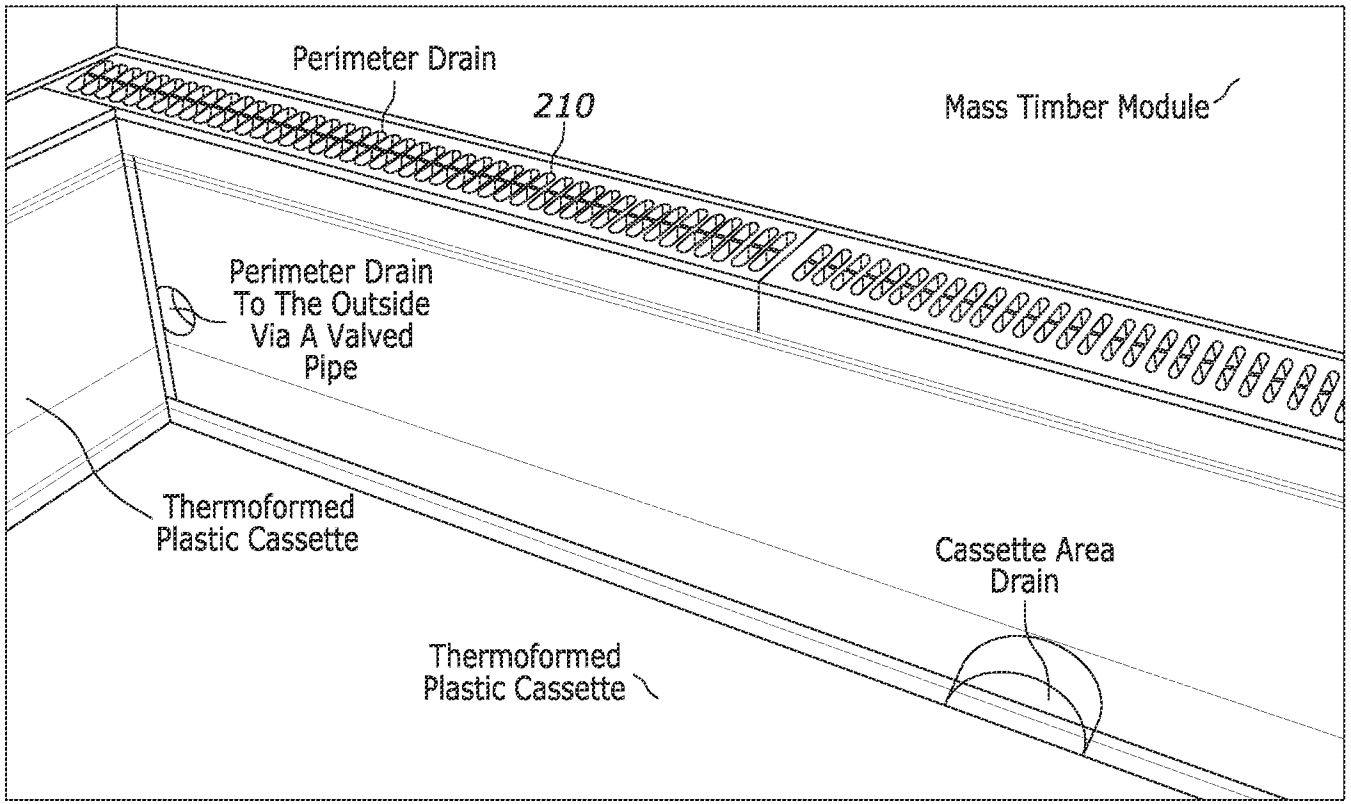
FIG. 4 is a close up view of a portion of the floor cassette that includes a perimeter drain in accordance with an illustrative embodiment.

FIG. 4 is a close up view of a portion of the floor cassette 200 that includes the perimeter drain 210 in accordance with an illustrative embodiment. FIG. 4 also depicts how the floor cassette 200 fits within the mass timber (or other material) that is used to construct the housing module. In an illustrative embodiment, the perimeter drain extends around the entire perimeter of the floor cassette 200. In this way, any water or other liquid that ends up on the floor of the housing module (i.e., due to a plumbing issue, spill, or other leak) is automatically removed from the module when it reaches the perimeter drain 210. As shown, the perimeter drain 210 is covered with a grating that allows liquid to enter for drainage purposes. The grating can be the same as or similar to a vent cover used to cover a floor vent in an HVAC system.

In an illustrative embodiment, the perimeter drain 210 of the floor cassette 200 has an internal slope which drains any collected liquid to the outside of the housing module via a valved drain pipe. The valve on the valved drain pipe can be a one-way valve that allows liquid out, but that closes to prevent water, cold air, rodents, insects, etc. from entering the floor cassette 200. In one embodiment, the valved drain pipe can act as a passive indicator that there is a leak or other water issue in the unit. Specifically, if water or other liquid can be seen running out of the pipe, this indicates to the observer that there is likely an issue in the unit. The floor cassette 200 also includes a cassette area drain. The area drain can be a central floor drain that collects any water/liquid on the floor that does not make it to the perimeter drain. In one embodiment, the area drain can connect to one or more of the valved drain pipes to drain any collected liquid out of the housing module.

In another illustrative embodiment, the perimeter drain can include one or more water sensors that are used to detect the presence of a liquid in the perimeter drain. The one or more water sensors can be mounted on the bottom of the perimeter drain, at an entrance to valved drain pipe, in the area drain, on an interior side wall of the perimeter drain, or elsewhere on or in the perimeter drain. The one or more sensors are connected to a communications network (e.g., Internet) such that sensed data can be provided to a remote location such as a server, a user device (laptop, cell phone, desktop, etc.), a website, a database, etc. so that an individual or system monitoring the housing module is made aware that there is a leak or other issue that is causing liquid in the cassette. The detected data can trigger a notification, message, or alarm on the computing system (e.g., a smartphone application) where it is received. In one embodiment, detection of a liquid by the one or more water sensors can also trigger an audio alarm in the unit so that any occupants are made aware of the issue. In this way, issues can be addressed rapidly and efficiently, before any permanent damage occurs to the housing module.

Figure 5:
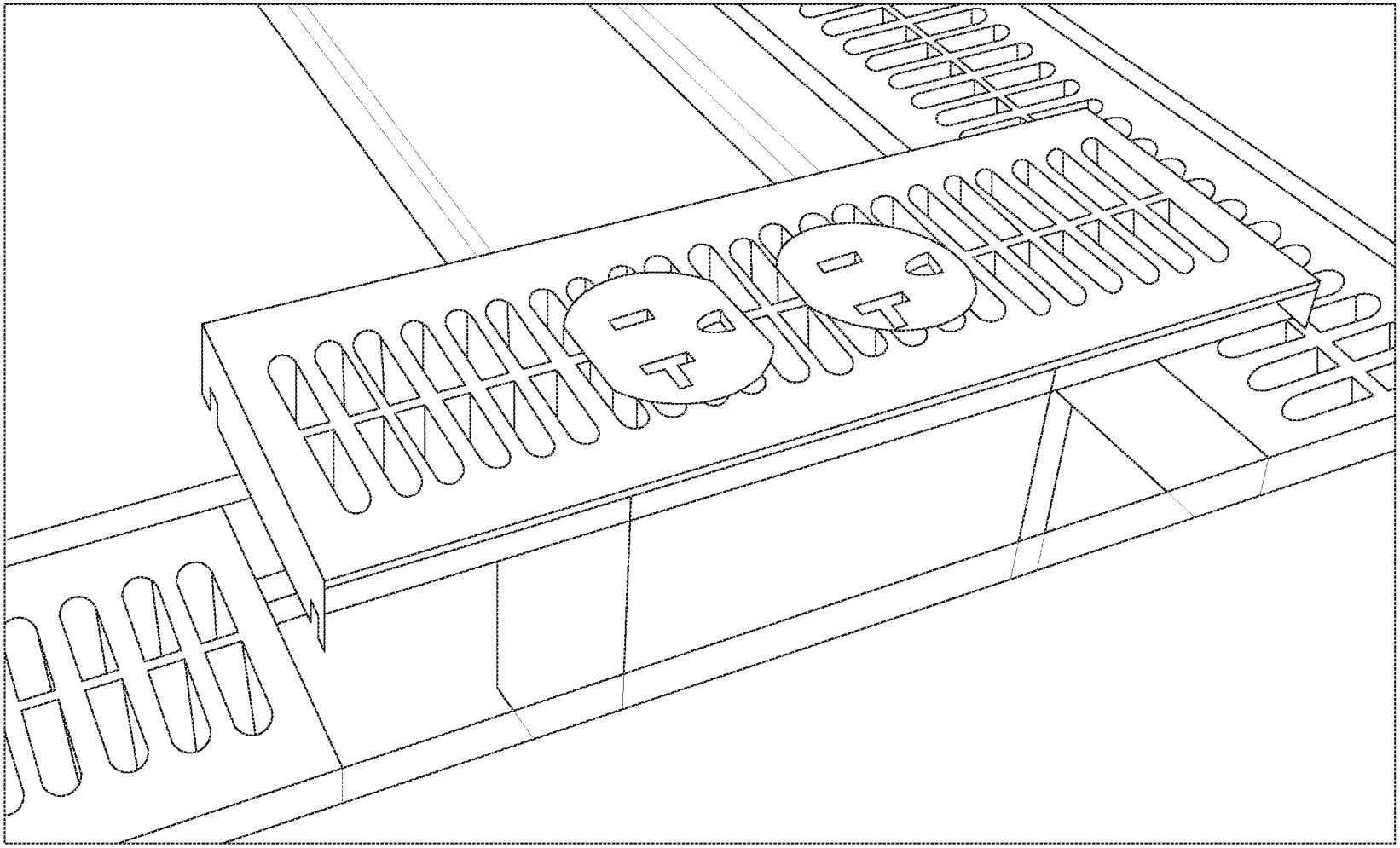
FIG. 5 depicts an electrical outlet incorporated into a movable perimeter drain grate section in accordance with an illustrative embodiment.

The perimeter drain 210 also acts as a raceway that supports electrical distribution lines. As a result, in one embodiment, electrical outlets can be incorporated into the grates that cover the perimeter drain. FIG. 5 depicts an electrical outlet incorporated into a movable perimeter drain grate section in accordance with an illustrative embodiment. As shown, the perimeter drain can be covered by a plurality of different grate sections, any of which can have one or more electrical outlets incorporated into them as shown in FIG. 5. As noted, the perimeter drain houses the electrical distribution lines that provide power to the electrical outlets. As a result, it is simple and straightforward for an occupant to rearrange the grate sections to place electrical outlets in any desired position around the perimeter of the housing module.

Figure 6:
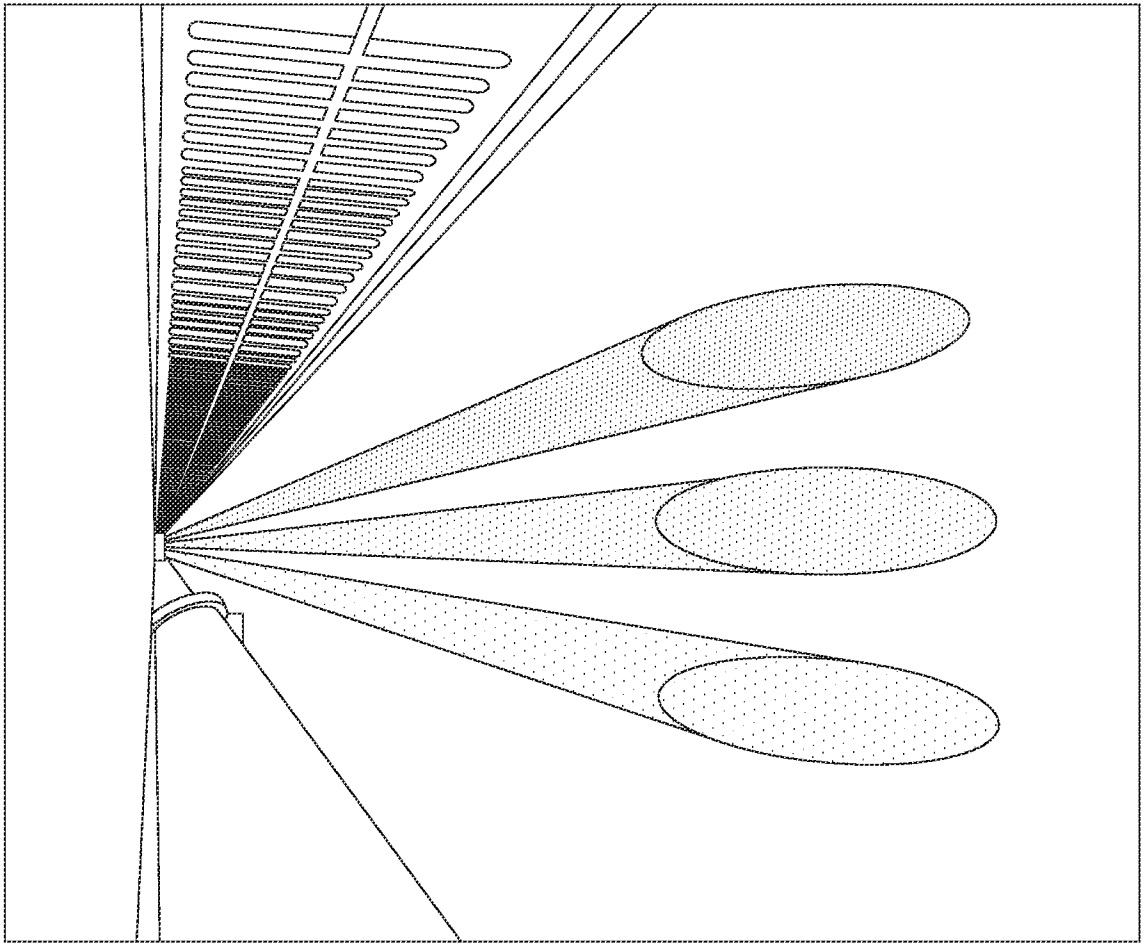
FIG. 6 is a sectional view that depicts electrical and information technology distribution lines within the perimeter drain in accordance with an illustrative embodiment.

The perimeter drain 210 also acts as a raceway for information technology lines, which are used to provide network access, television, phone, etc. to the housing modules. FIG. 6 is a sectional view that depicts electrical and information technology distribution lines within the perimeter drain in accordance with an illustrative embodiment. As shown, the distribution lines are positioned under the sections of grating that covers the perimeter drain so that they are not visible from within the finished housing module. As discussed above, the perimeter drain (and grate sections that cover it) also act as an air duct that enables the distribution of warm and cold air to the unit from a furnace, fan, air conditioner, or other HVAC unit.

Figure 7B:
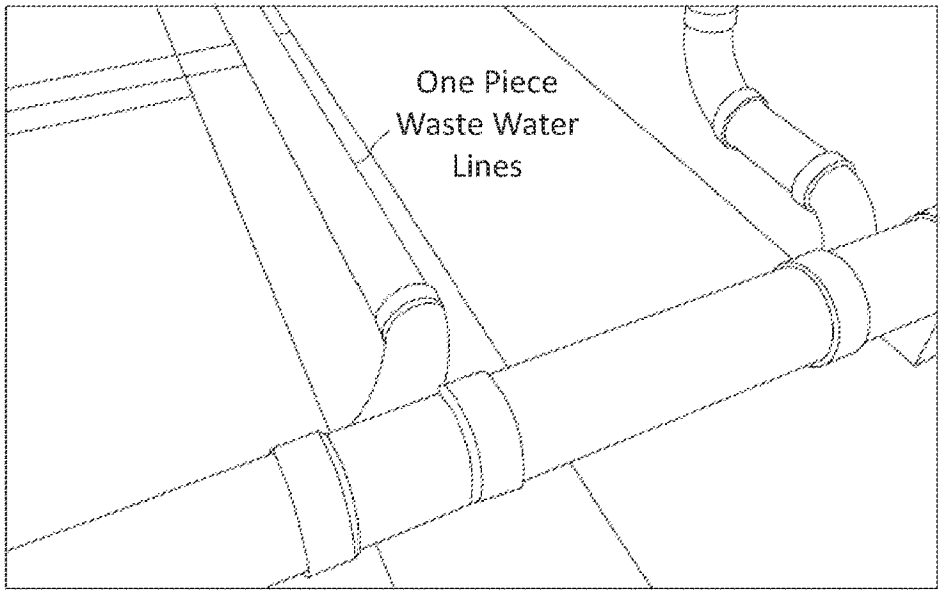
FIG. 7B depicts a one piece drain pipe in accordance with an illustrative embodiment.
Figure 7A:
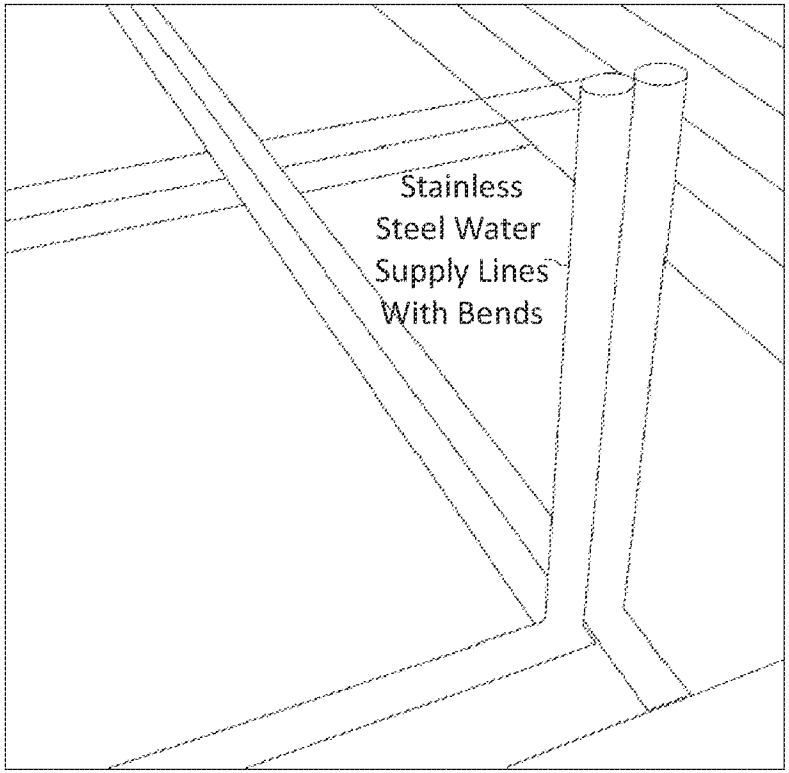
FIG. 7A depicts one piece water lines in accordance with an illustrative embodiment.

In another illustrative embodiment, the floor cassette can utilize a single piece hot water supply line, a single piece cold water supply line, and a single piece drain pipe. As used herein, single piece refers to a line with no joints, welds, connectors, glued connections, threaded attachments, etc. so that the possibility of failure is minimized. In one embodiment, the single piece drain pipe can be 3D printed (or produced using other advanced manufacturing techniques) to avoid the use of joints. The use of single piece incorporated water and drain lines also eliminates the need for a trained plumber to perform installation during erection of the module. The water supply lines can be made from bent stainless steel in one embodiment, and may utilize a conjunction manifold if required. Alternatively, the water supply lines can be made from another material such as copper, plastic, etc. The single piece drain pipe is used to collect waste from plumbing fixtures within the module, such as sinks, showers, tubs, toilets, etc. The single piece drain pipe can be made from acrylonitrile butadiene styrene (ABS), polyvinyl chloride (PVC), or another suitable material. FIG. 7A depicts single piece water lines in accordance with an illustrative embodiment. FIG. 7B depicts a single piece drain pipe in accordance with an illustrative embodiment.

The floor cassette also includes single point waste line and water line connections adjacent to or within the perimeter drain so that water and drains can easily be connected during installation of the module. In one embodiment, the single point waste line and water line connections can attach to the drain lines and water lines, respectively, using click type connectors such that the installation is quick and easy. Alternatively, any other type of connection known in the art to be used. The single point waste and water line connections also allow multiple housing modules to be stacked on top of one another.

Figure 8:
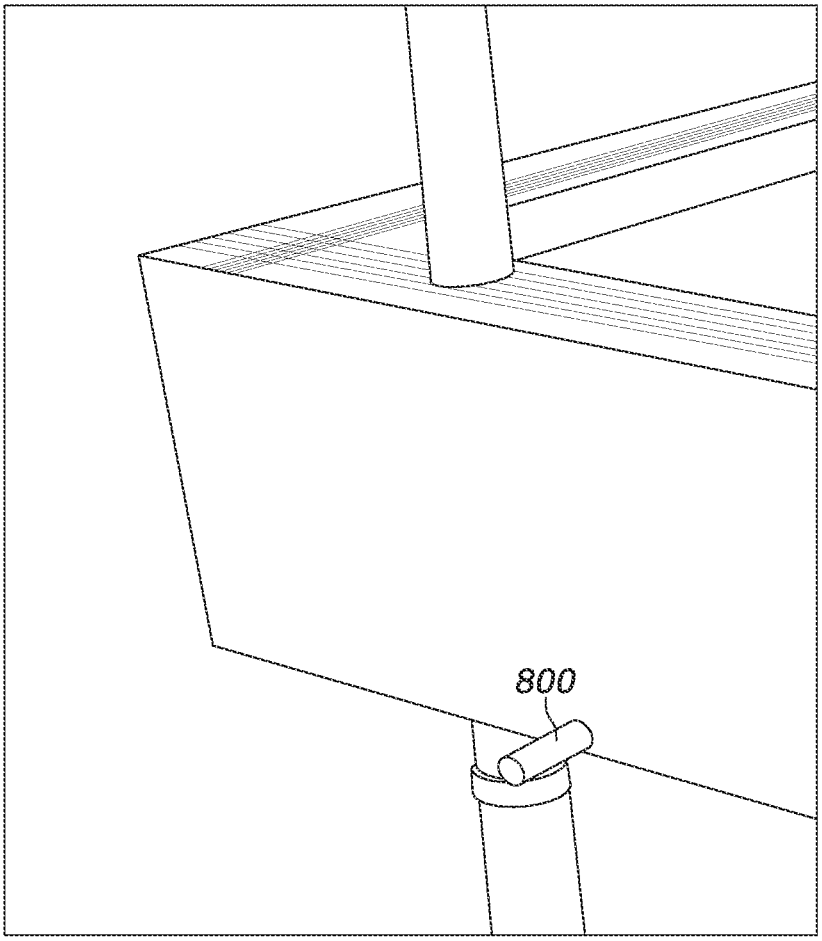
FIG. 8 depicts a one point water line connection in accordance with an illustrative embodiment.

FIG. 8 depicts a single point water line connection 800 in accordance with an illustrative embodiment. As shown, the single point water line connection 800 extends through an external wall of the floor cassette so that it can be connected to any standard water supply. The single point water line connection 800 is attached to the single piece cold water line that runs within the cassette. As also shown in FIG. 8, there is a drain pipe that extends vertically through the perimeter drain, illustrating how the drain can be run for stacked housing modules which can be below or above the depicted module. In an illustrative embodiment, one or more sensors is used to remotely monitor the water line entering the house. The sensor(s) can be a water/liquid sensor used to detect a leak in the water line and/or a flow sensor that detects whether water is flowing through the supply line, the amount of water that has flowed through the supply line, and a length of time that water has been flowing through the supply line. Using this information, a remote monitoring system can determine that the water has been left running at a fixture, that a toilet is continually running, that a fixture is leaking, etc. Responsive to determining that a water issue exists, the monitoring system can generate an alert or other notification such that the issue is addressed.

The floor cassette can also include a premanufactured wiring harness that is installed in a raceway or other cavity formed in the cassette. The wiring harness can connect to an electrical supply (e.g., the grid) and a network source (e.g., satellite dish), and can be used to provide all of the power and IT distribution for the housing module. The floor cassette can also include one or more batteries that connect to the electrical portion of the wiring harness. The one or more batteries are incorporated into a housing within the floor cassette, and are used to provide backup power to the housing module in the event that the main power supply goes offline. In one embodiment, the one or more batteries are supplied to keep basic systems operational for a period of time, such as a number of hours or days.

Figure 9:
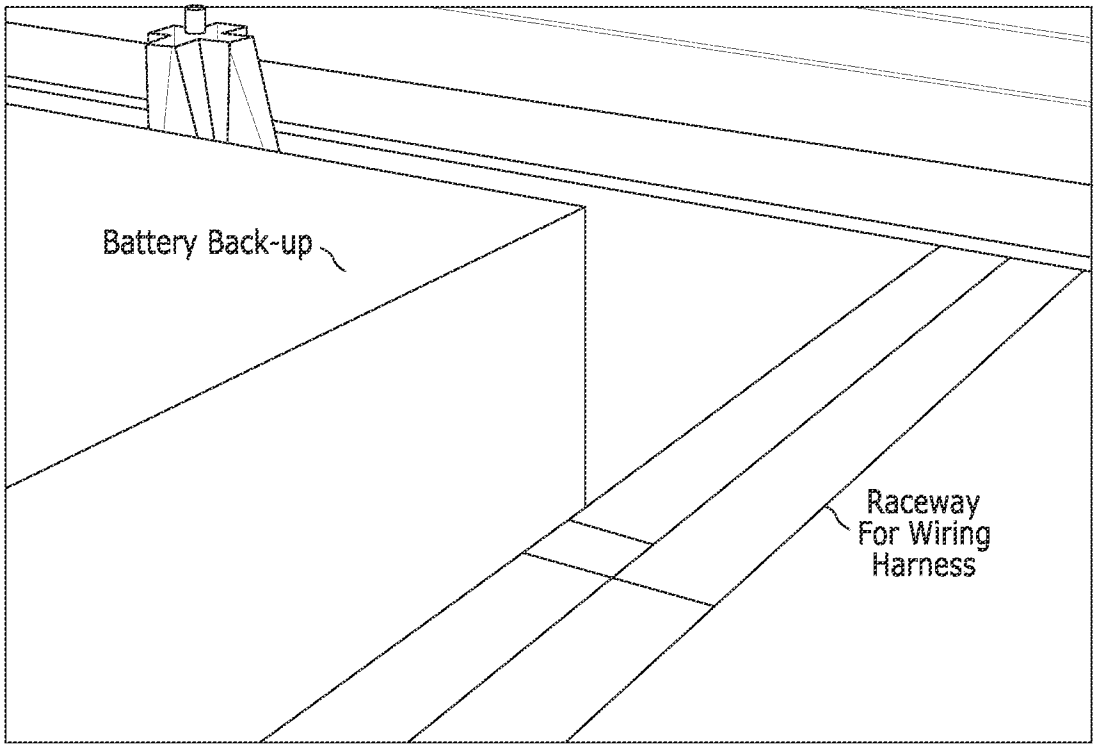
FIG. 9 is a partial view of a floor cassette that includes a raceway to house the wiring harness and a housing to hold a battery backup system in accordance with an illustrative embodiment.

FIG. 9 is a partial view of a floor cassette that includes a raceway to house the wiring harness and a housing to hold a battery backup system in accordance with an illustrative embodiment. Similar to the water system, the electrical system can also be monitored by one or more sensors. For example, a current sensor, voltage sensor, or power sensor can be used to monitor the amount of electricity being drawn into the wiring harness. Any spikes in electrical usage, continual high usage, or other anomalies can be detected by the one or more sensors and reported to the monitoring system, which in turn alerts an appropriate individual that there may be an issue. Additionally, a temperature sensor can be used to determine if the heat in the unit is working, and alerts can be generated if the unit is deemed to be too hot or too cold.

In another illustrative embodiment, the housing module described herein can utilize an exterior rainscreen. In a standard installation without a rainscreen, plywood sheeting is applied to the exterior (i.e., on the outside of the wall studs), a water resistive barrier (WRB) is applied over the plywood sheathing to help prevent outside moisture from entering the interior of the home, and exterior siding is placed over the WRB layer. With a rainscreen, a gap is provided between the WRB layer and the external siding to enable air flow and drainage of any moisture that gets behind the external siding. In a standard rainscreen installation, the WRB layer is applied to the plywood sheeting, and z-girts, battens, straps, or other type of vertical spacers (or sleepers) are mounted over the WRB layer. The vertical spacers act as a mounting location for the external siding such that the gap between the WRB layer and the external siding is present. The gap can be insulated in cold weather climates to help retain heat within the structure.

A problem with traditional rainscreen systems and the associated WRB layer, is that the WRB is installed onto the plywood sheathing, and then punctured thousands of times by the attachment of the vertical spacers (z-girt, wood, etc.) to the wall. The installation of the WRB layer itself, which often is done via stapling, can also result in numerous punctures to the WRB layer, which reduces its effectiveness. Described herein is a WRB layer that avoids these problems, and that can be mounted onto the exterior walls in the factory where the walls of the housing module are made.

The proposed WRB layer can be in the form of water proof and vapor transmittable loop section material that has the ability to mate with the second part of the system, the z-girt standoffs, similar to Velcro. For example, in an illustrative embodiment, vertical spacers in the form of z-girts, etc. are mounted directly over the loop formed water resistant barrier (WRB). A hook section of the WRB is attached to each the vertical spacers, which allows for these z-girts to be placed anywhere onto the loop section WRB previously applied to the module's exterior, forming a waterproof barrier without the need for fasteners penetrating the WRB.

Figure 10:
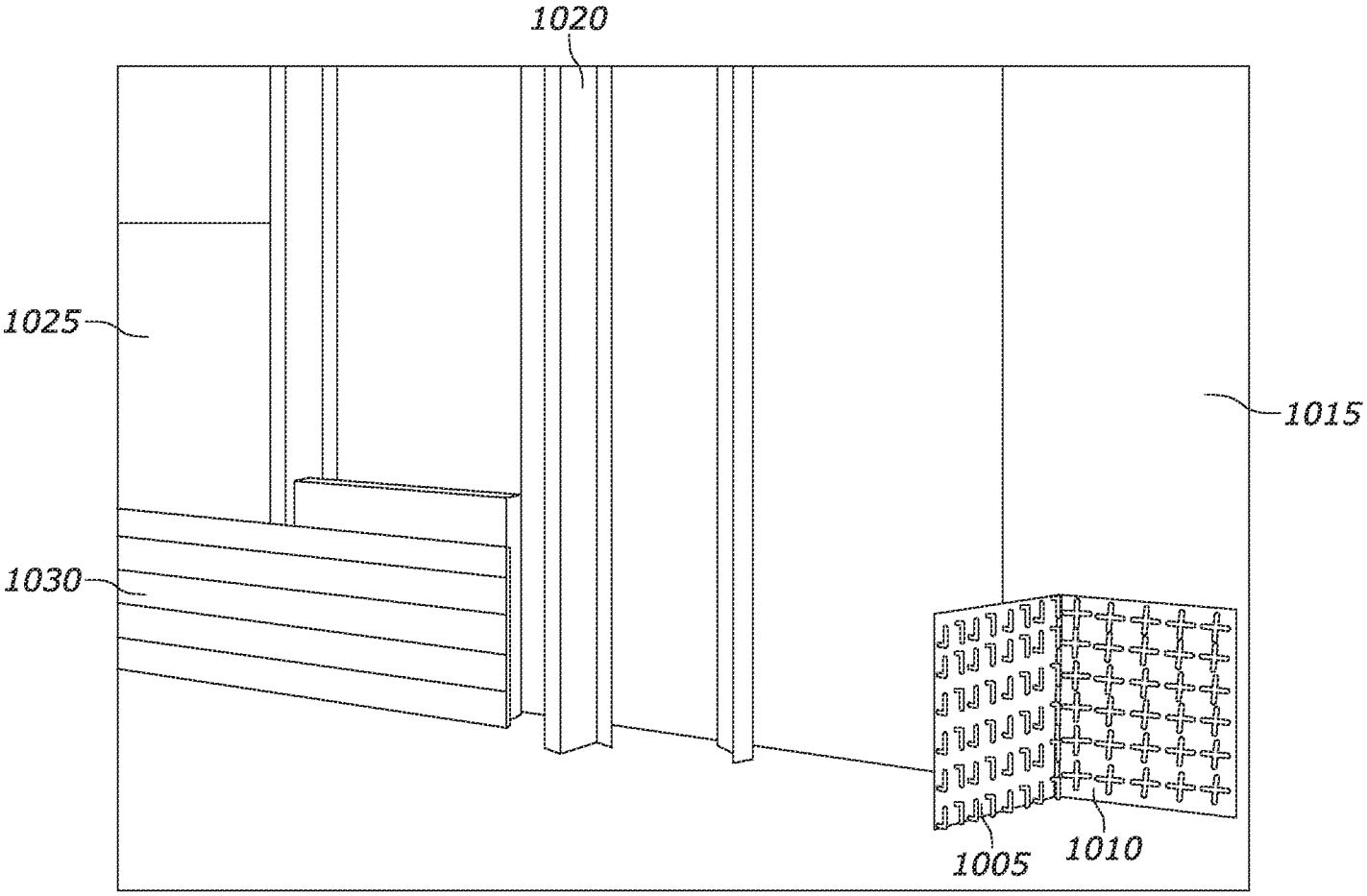
FIG. 10 depicts a rainscreen installation for a housing module in accordance with an illustrative embodiment.

FIG. 10 depicts a rainscreen installation for a housing module in accordance with an illustrative embodiment. As shown, the WRB layer is in the form of a loop section 1005 and a hook section 1010. As also shown, the loop sections 1005 are applied directly to the plywood sheathing 1015 on the exterior of the module, and the hook sections 1010 are applied to the vertical spacers 1020 mounted to the plywood sheathing 1015. Additionally, insulation 1025 can be applied over the WRB layer and in between the vertical spacers 1020. Exterior siding 1030 is mounted to the vertical spacers 1020.

By utilizing a hook and loop WRB system, penetrations in the WRB layer are eliminated, which improves the longevity of the sheathing, framing, and/or mass-timber products that exist behind the critical water resistive barrier. Additionally, by utilizing an industrial strength hook and loop system for the installation of the rainscreen system, the end user can place the sleepers where they need them to be based on their particular siding choice. For example, if a user chooses a heavier material (brick, etc.) then more sleepers can be used, and if they choose a lighter material (e.g., wood siding), then less sleepers are used. This approach to weather barriers will also expedite the industrial fabrication (factory) application of the WRB to the mass-timber on the assembly line.

Thus, described herein is a mass timber (or other) housing module onto whose floor a thermoformed plastic cassette is placed. The cassette contains the majority of the housing unit's operational features. The insertable cassette allows all operational features of the modular housing unit to be prefabricated and monitored as a cohesive unit. The modular design approach allows for efficient disassembly and reclamation of structural and utility components for reuse or recycling at the end of the building project's useful life.

Prefabrication of the Cassette and its operational features eliminates the need for the in-unit construction (once walls and ceilings are formed) of those operational features, making the housing module significantly more cost effective. The thermoformed cassette can include an HVAC system, waste line system, water supply system, electrical distribution system, data and technology distribution system, and a drainage system. Operational features can be monitored via the internet during assembly and home occupant use. Additionally, the proposed WRB layer saves additional time during erection of the module and results in a more energy efficient unit.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A floor cassette for a housing module comprising:

a base that is sized to fit under a floor of the modular housing unit;

a perimeter drain incorporated into a perimeter of the base, wherein the perimeter drain comprises a cavity designed to collect liquid from the floor of the modular housing unit;

wherein the cavity of the perimeter drain also comprises an air duct that delivers heated or cooled air to the modular housing unit; and an area drain spaced away from the perimeter of the base, wherein the area drain directs collected liquid from the floor to the cavity of the perimeter drain.

2. The floor cassette of claim 1, wherein the base comprises thermoformed plastic.

3. The floor cassette of claim 1, further comprising a plurality of grates that cover the cavity of the perimeter drain, wherein at least a portion of the plurality of grates are interchangeable grates that can swap positions with one another.

4. The floor cassette of claim 3, further comprising an electrical outlet mounted in an interchangeable grate of the plurality of grates such that the electrical outlet can be moved from a first location along the perimeter drain to a second position along the perimeter drain.

5. The floor cassette of claim 4, wherein the cavity of the perimeter drain acts as a raceway for an electrical line that supplies power to the electrical outlet.

6. The floor cassette of claim 1, wherein the cavity of the perimeter drain acts as a raceway for an information technology line that supplies network access to the housing module.

7. The floor cassette of claim 1, further comprising a one-piece water supply line incorporated into the base.

8. The floor cassette of claim 7, further comprising a one point water line connection that is mounted to the one-piece water supply line and that extends through an external wall of the base.

9. The floor cassette of claim 1, further comprising a one-piece plumbing drain line incorporated into the base.

10. The floor cassette of claim 9, wherein at least a portion of the one-piece plumbing drain line extends vertically within the cavity of the perimeter drain to accommodate stacking of housing modules.

11. The floor cassette of claim 1, further comprising a wiring harness mounted in a raceway formed in the base, wherein the wiring harness connects to an electrical supply line and to an information technology supply line.

12. The floor cassette of claim 11, further comprising one or more batteries mounted in a housing formed in the base, wherein the one or more batteries are connected to the wiring harness to provide back-up power to the housing module.

13. A method of forming a floor cassette, the method comprising:

forming a base of the floor cassette that is sized to fit under a floor of the modular housing unit;

forming a perimeter drain in the base wherein forming the perimeter drain comprises forming a cavity designed to collect liquid from the floor of the modular housing unit;

wherein the cavity of the perimeter drain is formed such that the cavity also comprises an air duct that delivers heated or cooled air to the modular housing unit; and forming an area drain in the base that is spaced away from the perimeter of the base such that the area drain directs collected liquid from the floor to the cavity of the perimeter drain.

14. The method of claim 13, further comprising mounting a plurality of grates to cover the cavity of the perimeter drain, wherein at least a portion of the plurality of grates are interchangeable grates that can swap positions with one another.

15. The method of claim 14, further comprising mounting an electrical outlet to at least one interchangeable grate such that the electrical outlet is movable from a first location to a second location along the perimeter of the housing module.

16. The method of claim 13, further comprising mounting an electrical line and an information technology line in a raceway that is formed in the cavity of the perimeter drain.

17. The method of claim 13, further comprising mounting a one-piece water supply line and a one-piece plumbing drain line into the base.

18. The method of claim 13, further comprising forming a housing in the base and mounting one or more batteries in the housing, wherein the one or more batteries are connected to a wiring harness to provide back-up power to the housing module.

* * * * *